United States Patent [19]

Asano

[11] Patent Number: 4,966,569

[45] Date of Patent: Oct. 30, 1990

[54] RADIO CONTROLLED TWO-WHEELED VEHICLE TOY

[75] Inventor: Kiyoji Asano, Tochgi, Japan

[73] Assignee: Green Corporation, Tochigi, Japan

[21] Appl. No.: 360,785

[22] Filed: Jun. 2, 1989

[30] Foreign Application Priority Data

Feb. 1, 1989 [JP] Japan ..... 1-9831

[51] Int. Cl.[5] ..... A63H 17/16

[52] U.S. Cl. ..... 446/440

[58] Field of Search ..... 446/431, 439, 440, 441, 446/454, 456

[56] References Cited

U.S. PATENT DOCUMENTS

| | | | |
|---|---|---|---|
| 3,751,851 | 8/1973 | Nagai | 446/440 |
| 3,785,086 | 1/1974 | Escobedo | 446/440 |
| 4,201,011 | 5/1980 | Cook | 446/440 |
| 4,267,663 | 5/1981 | Nagahara | 446/440 |
| 4,290,228 | 9/1981 | Goldfarb et al. | 446/440 |
| 4,309,841 | 1/1982 | Asano | 446/440 |
| 4,342,175 | 8/1982 | Cernansky et al. | 446/440 |
| 4,383,388 | 5/1983 | Suimon | 446/440 |
| 4,563,164 | 1/1986 | Tao | 446/440 |

FOREIGN PATENT DOCUMENTS

| | | |
|---|---|---|
| 52-24078 | 6/1977 | Japan . |
| 55-156799 | 11/1980 | Japan . |
| 57-64076 | 4/1982 | Japan . |

*Primary Examiner*—Robert A. Hafer
*Assistant Examiner*—S. Rimell
*Attorney, Agent, or Firm*—Michael J. Striker

[57] ABSTRACT

A radio controlled type two-wheeled toy vehicle provided with a pivotable battery case at its lower part and steerable by swinging right and left with respect to a running direction, the weight of the battery case with the battery case being swung right and left with respect to the running direction by a radio control and with the front wheel supporter being more inclined together with the battery case in the direction of swinging of the vehicle than the toy vehicle body to change the running direction.

4 Claims, 6 Drawing Sheets

RADIO CONTROLLED TWO-WHEELED VEHICLE TOY

BACKGROUND OF THE INVENTION

1. Field of the Invention

The present invention relates to a radio controlled two-wheeled vehicle toy and more particularly to a two-wheeled vehicle toy which can smoothly and reliably switch in right and left directions.

2. Description of the Prior Art

It has been difficult to commercialize a radio controlled two-wheeled vehicle toy since it is less stable in its movement and has a more complicated steering mechanism than a four-wheeled vehicle.

Heretofore, as a steering mechanism for a radio controlled two-wheeled vehicle, a mechanism has been provided in which a weight mounted on the top of a vehicle is moved in the right and left directions by a radio control system, and a steering section mounted on the front wheel, is rotated right and left in response to the movement of the weight as disclosed in the Japanese Utility Model Publication No. 52-24078.

It is, however, believed that this type of steering mechanism causes a vehicle to turn over when negotiating a sharp curve, since it makes the vehicle unstable and has an inferior steering characteristic because the weight is positioned at the upper portion of the vehicle. Hence, it has been necessary to install a stand at the bottom of the vehicle to prevent the vehicle from being turned over, and provide a mechanism for positively rotating right and left the steering section responsive to the actions of the weight. As a result, the existing two-wheeled vehicle toy has a complicated mechanism and a less aesthetic appearance.

The Japanese Patent Laid-Open Application No. 57-64076 discloses a steering mechanism in which a frame is provided with a servo mechanism and a cell at the lower portion of the vehicle so that the frame is moved by a remote control, and the vehicle is inclined right and left for a steering purpose by using the weights of the servo mechanism and the cell.

This type of steering mechanism is more stable and has a superior steering characteristic than the mechanism described earlier because the weight is located at the bottom of the vehicle. This mechanism is suited for a moderate curve, but when the vehicle negotiates a sharp curve, the frame as a center of gravity should be turned right and left to a great extent. However, because of the limited space of the two-wheeled vehicle, it is difficult to design a mechanism including the frame, since a motorcycle has an insufficient width. If the width and the swing arc of the frame are made larger, it is necessary to enlarge the swing of a crank attached to the servo mechanism. In this case, the deficiency of power supplied by the servo mechanism does not permit the crank to be smoothly swung. Moreover, a drawback of this steering mechanism consists in that the direction cannot be rapidly switched because it takes much time to swing back the frame due to the large swing arc.

Furthermore, the Japanese Patent Laid-Open No. 55-156799 has proposed a construction wherein the steering section located at the front wheel is linked to the servo mechanism for forcing a vehicle body to be banked by directly swinging the steering section right and left by the remote control operation.

This type of steering mechanism, however, lacks stability because of the innate characteristic of the two-wheeled vehicle. That is, since the two-wheeled vehicle is of a rear wheel driven type, it has an inertia when going straight, and if the steering is served by only the front wheel, the vehicle body becomes unbalanced. Therefore, handling operation should be reduced to a minimum.

A recently filed U.S. Application, Ser. No. 222,124 by the inventor herein and assigned to the assignee of the subject application discloses providing in the radio control type two-wheeled vehicle toy, a battery housing which is rotatably mounted at the lower part of the vehicle body and is moved right and left with respect to a running direction of the vehicle by the radio control operation, so that the vehicle body is inclined for steering purposes, right and left by making use of the weight of the battery Using the weight of the battery housing substantially improves handling of the two-wheeled toy vehicle.

SUMMARY OF THE INVENTION

The object of the present invention is to provide a mechanism which would enable rapid change of a running direction of the vehicle. The object of the invention is achieved by constructing the vehicle such that, if the vehicle body is inclined by turning the battery right and left, a support for a front wheel is inclined to a greater extent than the vehicle body, and the running direction can be rapidly switched by only inclining the vehicle body slightly.

According to a feature of the invention, the battery housing is connected to the support of the front wheel via a linkage mechanism, so that the support is inclined right and left in association with the battery housing. A clutch mechanism is provided to the linkage mechanism, so that the front wheel support is exactly inclined following the turning of the battery housing. If a large load is applied to the linkage mechanism, the clutch mechanism gets out of gearing so as not to damage the linkage mechanism.

According to another feature of the invention, a racer or a driver and others mounted on the vehicle are equipped therewithin with balance weights which may be turned right and left to accelerate an inclination of the vehicle at turning in the running direction to rapidly change the running direction.

These and other objects and advantages of the present invention, together with additional objects and advantages thereof, will be best understood from the following description of the preferred embodiment with reference to the appended drawings.

DESCRIPTION OF THE PREFERRED EMBODIMENT

Figure 1:
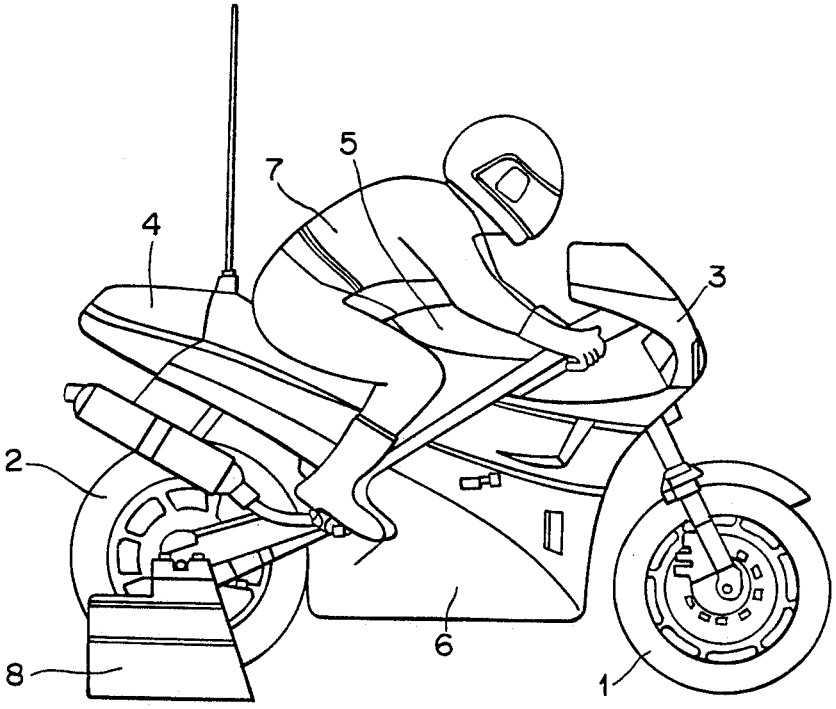
FIG. 1 is a perspective view showing a two-wheeled vehicle toy according to the present invention.

FIG. 1 shows a motorcycle toy according to the invention comprising a front wheel 1, a rear wheel 2, a front cowl 3, a rear cowl 4, a tank 5, a battery cover 6, a rider doll 7, and a stand 8 for supporting a rear wheel of the motorcycle toy at starting.

Figure 2:
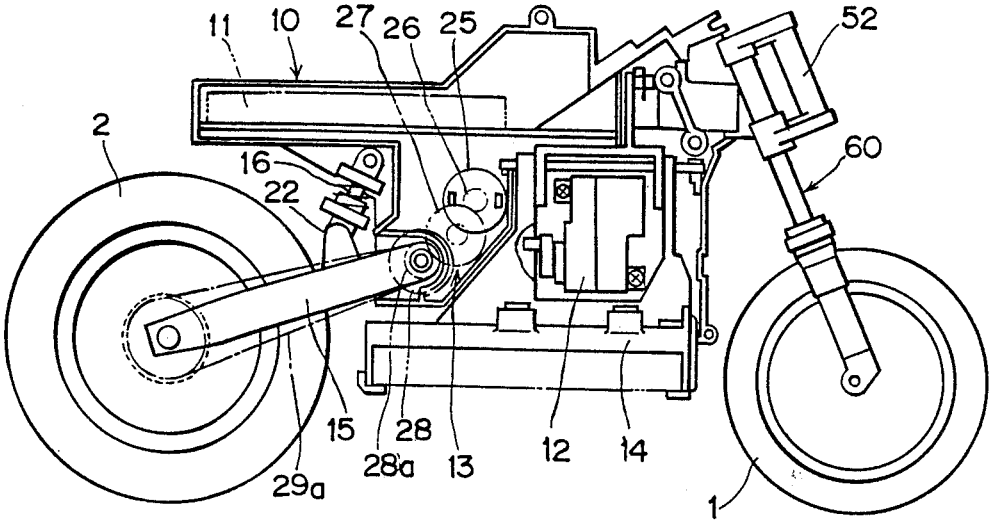
FIG. 2 is a general view, schematically showing the two-wheeled toy vehicle according to the invention with some parts such as a cowl being removed from the vehicle.

FIG. 2 schematically shows the motorcycle shown in FIG. 1 with some parts such as the front cowl 3, the rear cowl 4, the tank 5, the battery cover, the driver 7, and the handle being removed. Reference numeral 10 designates a box-like vehicle body frame.

The vehicle body frame 10 accommodates an electronic circuit store section 11 incorporating electronic circuits such as a receiver circuit and control circuits of various motors therein, a servo mechanism 12 and a rear wheel-driving mechanism 13. A battery case 14 is mounted on the bottom of the vehicle body frame 10 so as to allow the battery case 14 to pivot right and left.

Figure 3:
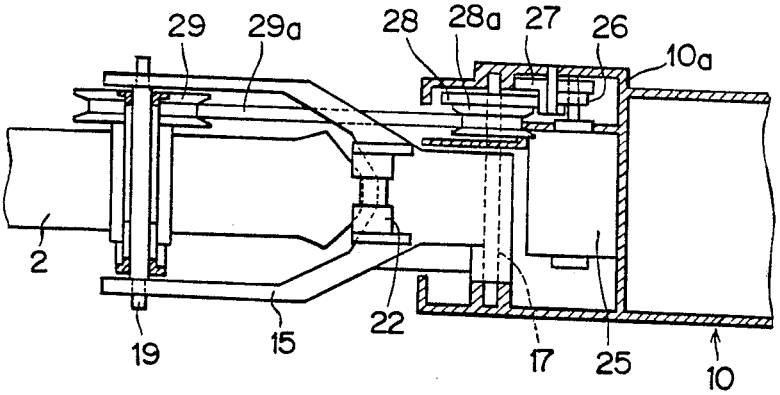
FIG. 3 is a partially sectional view schematically showing an assembly of a rear wheel and a driving mechanism.

The reference numeral 15 is a swing arm for supporting the rear wheel 2. As shown in FIG. 3, the front end of the rear wheel is rotatably pivoted on a gear box section 10*a* of the vehicle body frame 10 by a pin 17. The swing arm 15 is vertically movable around the pin 17. The swing arm 15 is pivoted with the rear wheel 2 at its rear end by a pin 19.

Furthermore, as shown in FIG. 2, a spring 16 extends between a bearing 22 of the swing arm 15 and the vehicle body frame 10. The spring 16 applies a spring vertical force to the swing arm 15.

The gear box section 10*a* accommodates a driving mechanism of the rear wheel 2. A motor 25 has a driving gear 26 fixed to the shaft thereof. The driving gear 26 rotates a middle gear 27 which in turn rotates a driven gear 28. The gear 28 includes a coaxial pulley 28*a*. The rotation of the gear 27 is transmitted to the rear wheel 2 through a belt 29*a* extending between the pulley 28 and a pulley 29 fixed to a pivoting pin 19.

Figure 4:
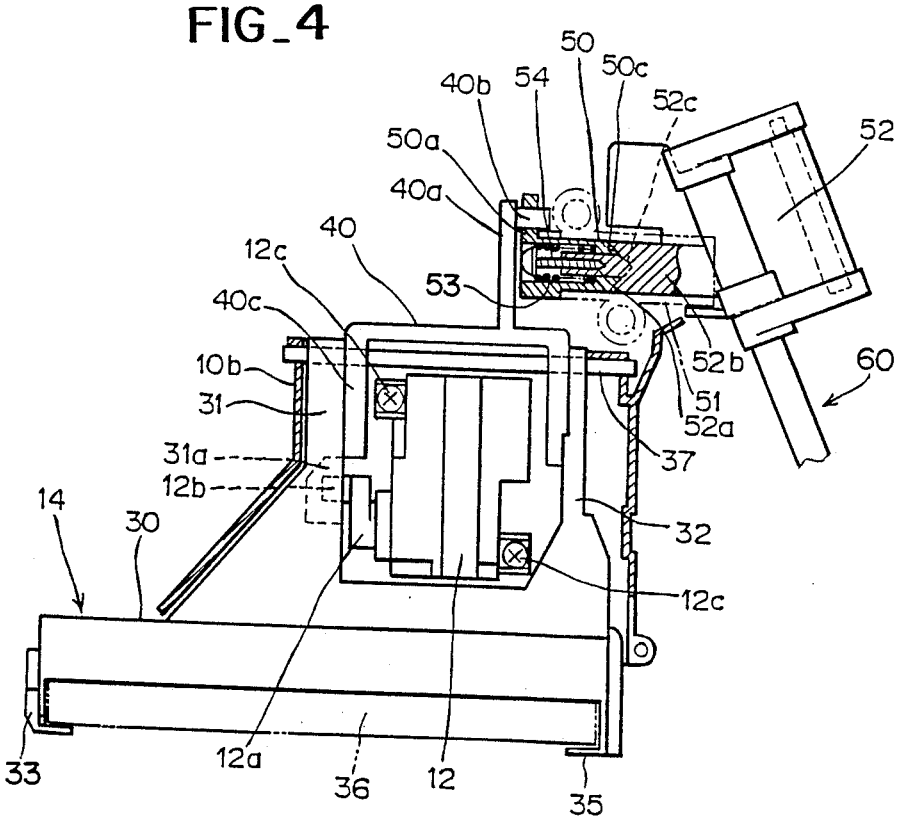
FIG. 4 is a partially cross-sectional view showing a gearing mechanism of a battery housing and a front fork.
Figure 5:
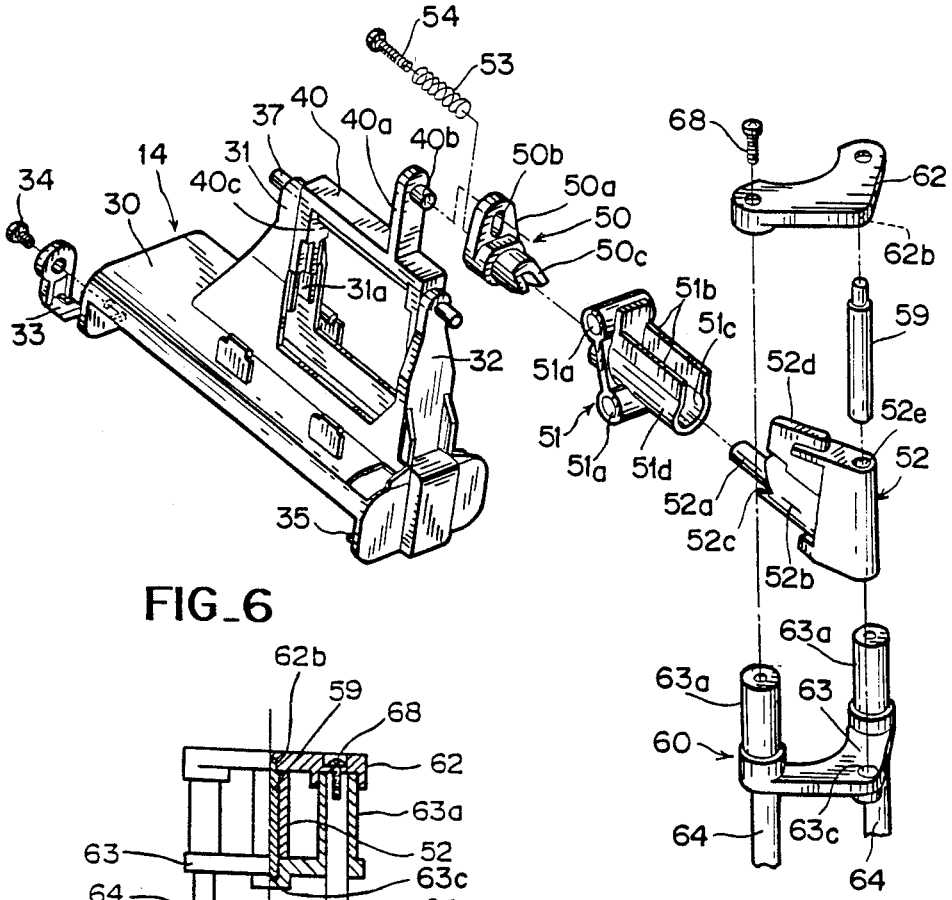
FIG. 5 is an exploded view of the gearing mechanism of the battery case and the front fork.

FIGS. 4 and 5 show a linkage mechanism between the front fork 60 supporting the front wheel 1, and the battery case 14.

The battery case 14 includes a case body 30 and front and rear supporting arms 31 and 32 which are on the upper part of the case 14. The case body 30 includes a battery lock 33 attached thereto with a screw at the front section thereof, so that the battery lock 33 may be swung. The rear end of the case body 30 has a battery holding projection 35 (although not shown in the drawings, the lock 33 and the projection 35 comprise two parts). The case body 30 holds the battery 36 therein, and the bottom of the battery 36 is supported by the locks 33 and the holding projection 35. The lock 33 is rotated outside of the case 30 when the battery 36 is attached to and detached from the case body 30.

A crank arm 40 extends between the supporting arms 31 and 32, and on which a lever 40*a* with a short rod 40*b* is supported. The crank arm 40 continues, at its both lower parts 40*c*, to the supporting arms 31, 32, though this is not shown in detail A pin 37 passes through the both supporting arms 31, 32 and the crank arm 40, and passes at its both ends through walls of the servo mechanism housing 10*b* of the vehicle frame 10. Therefore, the battery case 30 pivots around the pin 37 as fulcrum in the right and left directions with respect to the movement of the two-wheeled vehicle.

The servo mechanism 12 is, as shown in FIG. 4, fixed by screws 12*c*, to the servo mechanism housing 10*b*. The servo mechanism 12 is equipped with a small sized motor and a reduction gear (not shown), for rotating the crank 12*a* to the right and left in response to signals from a transmitter. An end portion 12*b* of the crank 12*a* engages a vertical groove 31*a* formed in the support arm 31 for the rear part of the battery case 14, so that the battery case 14 is swung right and left upon rotation of the crank 12*a*.

The battery case 14 and the front fork 60 are connected by a linkage mechanism as shown in FIG. 5. The reference numeral 50 designates a crank, reference numeral 51 designates a communication tube, and reference numeral 52 designates a header.

In the crank 50, an end portion 50*c* is formed with a predetermined acute angle, and a rear portion is formed with a bracket part 50*a* having an elongated opening 50*b* in which the short rod 40*b* of the crank arm 40 is engaged.

The communication tube 51 is formed with screw holes 51*a*, 51*a* at its rear portion, and a cylindrical part 51*d* has a slit 51*c* in its upper part and has stopper plates 51*b* at its both sides.

Further, the header 52 has a communication rod 52*b* at its rear portion, which is formed with a cutout 52*c* corresponding to the acute angled end portion 50*c*, and has a pin 52*a* at its rear portion. The header 52 has a rib 52*d* at its upper portion.

The cylindrical part 51*d* of the communication tube 51*d* together with the end portion 50*c* of the crank 50 is received on the communication rod 52*b* of the header 52, and the both shafts are engaged at the end portion 50*c* and the cutout 52*b*. The screw 54 is inserted from the rear of the crank 50 via the spring 53. As shown in FIG. 4, the end of the screw 54 is inserted into the pin 52*a* so that the header 52 is rotatable.

The communication tube 51 is fixed to the inner side of the vehicle frame 10 by a screw (not shown) passing into the threaded holes 51*a*.

When the battery case 30 is turned around the fulcrum of a pin 37 by the above mentioned linkage mechanism, the crank 50 is rotated via the lever 40*a* of the crank arm 40, and the header 52 is inclined right and left, accordingly. But if the header 52 is inclined more than the predetermined angle, the rib 52*d* contacts the stopper plates 51*b* of the communication tube 51, and the header does not incline any more. Thus, if the battery case 30 is turned by the servo mechanism 12 to a greater extent and rotates the crank 50 more than required, the connection between the end portion 50*c* and the cutout 52*c* is released, and the crank 50 only rotates.

Under normal condition, the spring 53 biases the crank 50 into engagement with the header 52, and the end portion 50*c* of the crank 50 engages the end, portion 52cof of the header 52. However, when the rib 52*d* of the header 52 hits one of the side stopper plates 51*b* and the header stops to rotate while the rotation of the crank 50 continues, the end portion 52*c* of the header acts as a cam on the end portion 50*c* of the crank 50 and moves the crank 50 against the spring 53, so that the crank 50 becomes disengaged from the header 52 and does not apply a force thereto which otherwise might have caused damage of the header.

Figure 6:
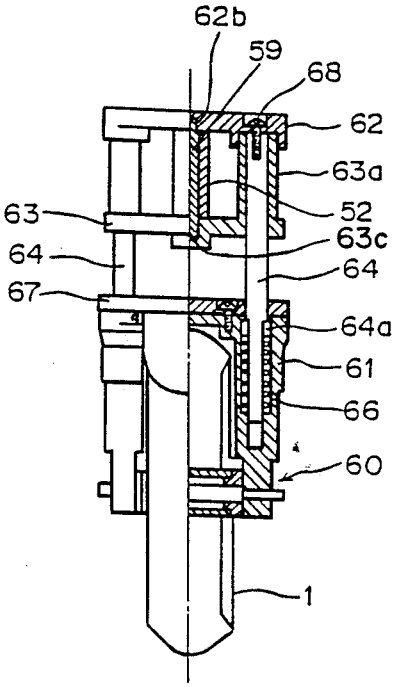
FIG. 6 is a half sectional view of the front fork.

FIG. 6 shows a front fork 60 for supporting the front wheel to be connected to the header 52. The front fork 60 comprises right and left actuator tubes 61 and upper and lower brackets 62, 63, and the sheft 64 for connecting these member.

The outer tube 61 is pivoted at its lower portion with the front wheel 1 which is connected therewith by a pin 65. The outer tube 61 contains a spring 66 therein, and the lower portion of the shaft 64 is inserted into the spring 66. The upper portion of the outer tube 61 contains a pushing plate 67 fixed by a screw, and the pushing plate 67 serves to push a stopper 64*a* fixed on the middle portion of the shaft 64 from the top. Such a construction allows the outer tube 66 rotatably supporting the front wheel 1 to be elastically moved up and down on the shaft 64.

The upper portion of the shaft 64 is inserted into a coupling cylinder 63*a* of the lower bracket 63. The upper end of the coupling cylinder 63*a* contains the upper bracket 62 attached thereon. The upper bracket 62 and the upper end of the shaft 64 are linked by a screw 68, so that the upper and lower brackets 62, 63, the shaft 64 and the outer tubes 61 are integrally combined with one another.

The front fork 60 is connected to the header 52 by a coupling pin 59. The header 52 is, as shown in FIG. 5, formed with a pin insertion hole 52*e* into which the pin 59 is inserted, the pin 59 being inserted into holes 62*b*, 63*c* of the upper and lower brackets 62, 63. Thereby, the front fork 60 is pivoted rotatably around the pin 59. If the front fork 62 is turned by the predetermined angle, the header 52 contacts the coupling cylinder 63*a* so that the front fork 60 does not rotate too much.

In the present invention, since the header 52 is pivoted by end portions of the upper and lower brackets 62, 63, the movement is stabilized.

Figure 7:
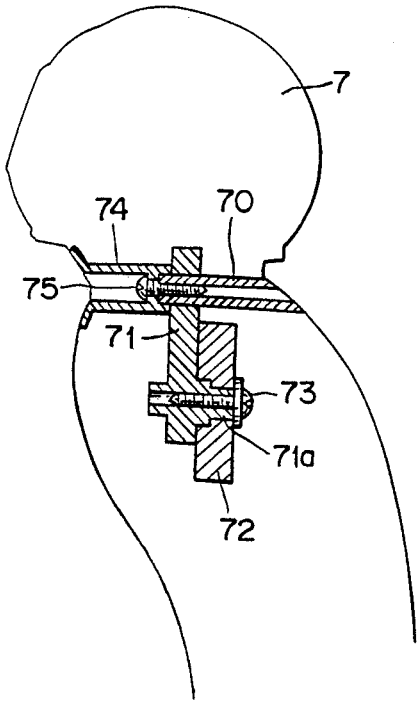
FIG. 7 is a side cross-sectional view showing a balance weight within a racer.
Figure 8:
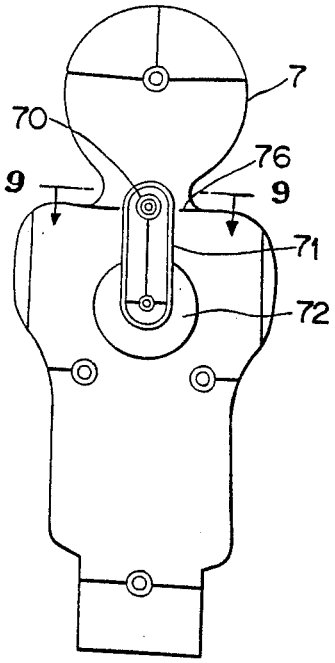
FIG. 8 is a front schematical view of the balance weight within the racer.

A balance weight 72 is rotatably arranged within the driver 7 secured on the upper part of the vehicle. As seen in FIGS. 7 and 8, a hollow pivot shaft 70 extends around the interior of the driver's neck, and an arm 71 is connected with the pivot shaft 70. The pivot shaft 70 is received in an insertion shaft 74 located at an opposite side and is fixed by a screw 75. The lower end of the arm 71 is formed with a stem 71*a* to which a circular balance weight 72 is fixed by a screw 73, so that the balance weight 72 is turned right and left within the driver 7 with respect to a running direction.

Figure 9:
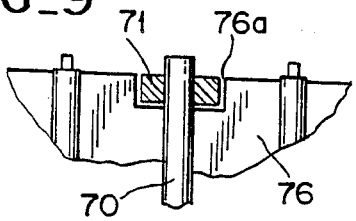
FIG. 9 is a view along the section A—A in FIG. 8.

The shaft 70 is formed at its both sides with an expanding face 76 as shown in FIG. 9, and the expanding face 76 is formed with a cutout 76*a* around the shaft 70. The arm 71 is inserted between the cutouts 76, and when the arm 71 is turned right and left, the upper portion of the arm contacts the both sides of the cutout 76 so as not to turn more than necessary.

The balance weight 72 is provided on the central longitudinal line of the vehicle and in the upper portion of the doll driver.

In the present embodiment, the balance weight 72 is arranged within the driver 7, but it may be located outside of the driver or other mounting means instead of the driver, if required.

Further, the operation of the radio controlled type two-wheeled vehicle will be explained.

Figure 10C:
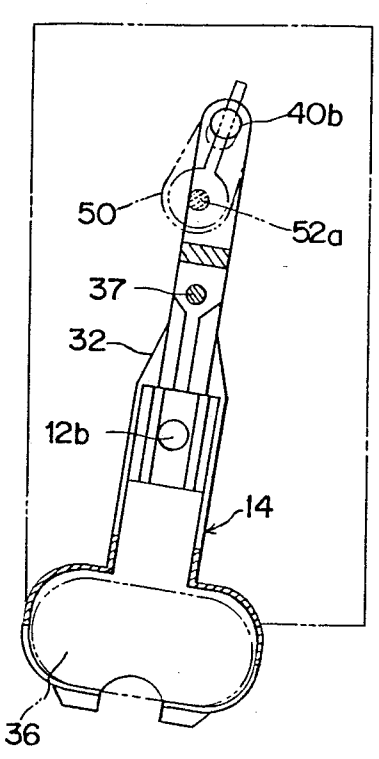
FIG. 10 (A), (B), (C) are schematical views showing turning of the battery case.
Figure 10B:
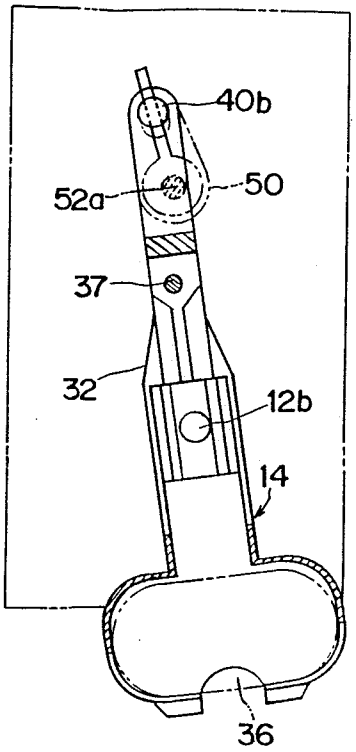
Figure 10A:
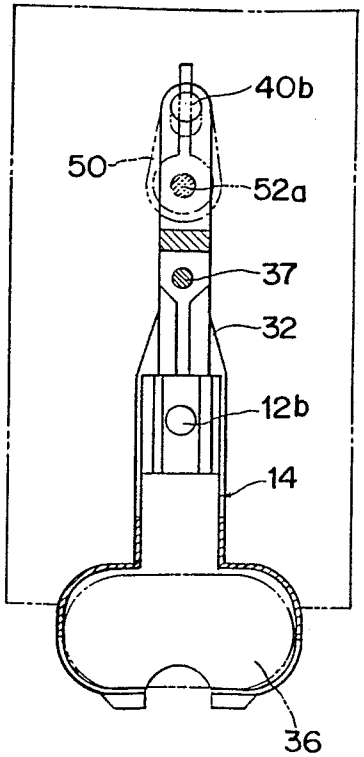
Figure 11:
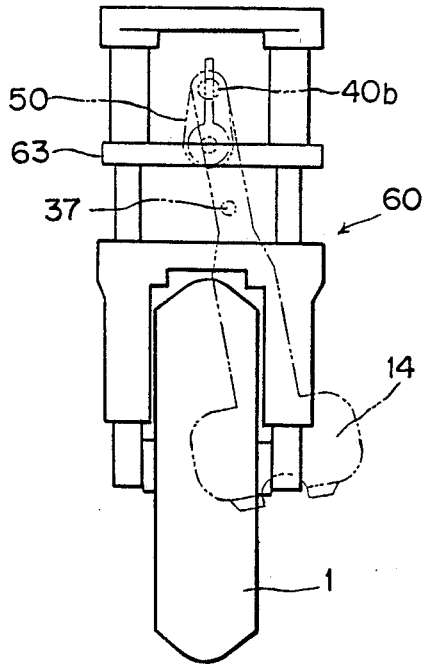
FIG. 11 is a schematical view showing the vehicle body inclined to the right side.
Figure 12:
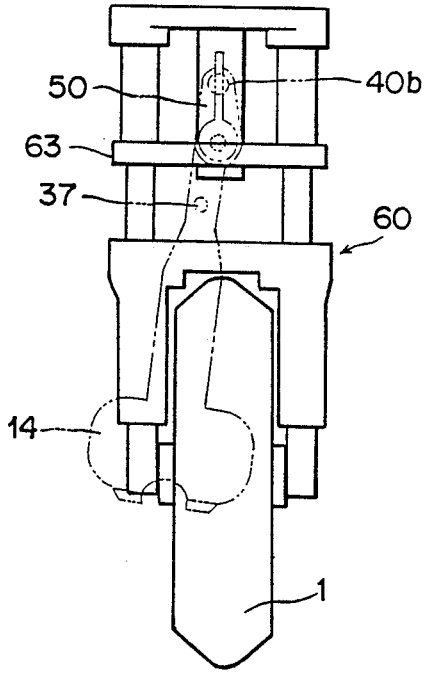
FIG. 12 is a schematical view showing the vehicle body inclined to the left side.

The battery 36 is held in the battery case 14 and then a power switch (not shown) is turned on. When a motorcycle moves straightforward, the battery case 14 is kept in a balanced state as shown in FIG. 10. In case of swivelling the motorcycle to the right, the crank 12*a* of the servo mechanism 12 is swung to the right in response to a signal fed from a transmitter in such a manner that the battery case 14 is also swung to the right relative to the direction of movement as shown in FIG. 10(B). The center of gravity of the vehicle body is moved to the right as shown in FIG. 11. At the same time, the inclination of the battery case 14 is transmitted to the header 52 via the crank arm 40 and the crank 50, so that the front fork 60 connected with the header 52, and the front wheel 1 supported by the front fork are more inclined than the vehicle body.

Figure 13:
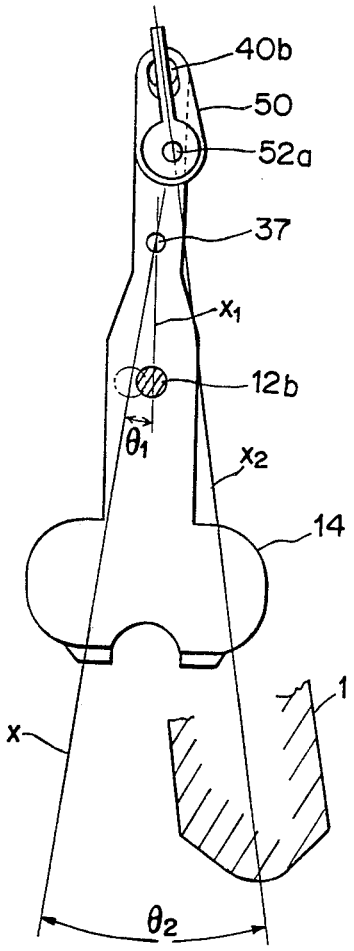
FIG. 13 is a schematical view showing the inclination of the front wheel.

FIG. 13 shows schematically the above state. When the battery case 14 is inclined by $\theta$ 1 from the center line X to Xl, the front wheel 1 is inclined to X2 by the above linkage mechanism, and only the front wheel is inclined by $\theta$2 from the center line X (for example, if $\theta$1 is 8°, the front wheel 1 is inclined by additional 8°, and $\theta$2 is 16°).

In the present invention, when the vehicle is inclined to the right, the balance weight 72 within the driver 7 also swings to the right to accelerate moving of the center of gravity of the vehicle.

Thus, according to the invention, the vehicle can make a sharp curve to the right side by a synergistic effect of the weight of the battery, the inclination of the front fork associated with the battery, and the balance weight of the driver.

In case of swivelling the two-wheeled vehicle to the left, as shown in FIG. 11, the swinging of the servo crank 12*a* to the left allows the battery case section 14 to swing to the left and thus the center of gravity of the vehicle body to move to the left. At the same time, the front fork 60 and the front wheel 1 are further inclined to the left by the linkage mechanism, and as the balance weight within the driver 7 is swung to the left, the vehicle can make a sharp curve to the left side.

The inclination angle range of the front fork 60 is determined by inclination of the header 52 which is limited by the stopper plates 51*b*, 51*b* of the communication tube 51. If a force larger than necessary is applied to the linkage, the crank 50 is disconnected from the connection shaft 52*b* to prevent an overload of the servo mechanism and others.

According to the present invention, when the battery case is turned to the right and left, and the vehicle body is inclined for steering purposes, the front fork supporting the front wheel is forcibly inclined right and left because of their association with the battery case, and the balance weight in the driver is turned to the steering direction, so that the center of gravity is rapidly shifted for exact steering Further, since the clutch mechanism is provided between the linkage mechanism of the battery case and the front fork, application of excess load to the driving mechanism and the linkage mechanism is avoided.

Furthermore, steering of the vehicle may be effected with a slight inclination, so that the running is stable, especially when the vehicle makes a sharp curve. At a low speed, the advantages provided by the invention are especially remarkable.

While the invention has been illustrated and described with reference to a specific embodiment of a two-wheel radio controlled toy vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A radio-controlled two-wheeled toy vehicle comprising a body; front and rear wheels; a drive mechanism for the rear wheel; a support for the front wheel; a battery case arranged in a lower part of the toy vehicle body; means for pivoting said battery case right and left with respect to a direction of movement of the vehicle in response to a signal from radio control means to provide for the toy vehicle steering to the right and left, respectively; means for connecting said battery case to said support for the front wheel for enabling inclination of said support for the front wheel and said front wheel to the right and left in accordance with swinging of said battery case to the right and left, respectively; and a driver element mounted on seat of the toy vehicle and having balance weights arranged within said driver element swingable right and left with respect to a direction of movement of the toy vehicle to accelerate inclination of the toy vehicle body in a respective direction to thereby enable a rapid change of the direction of movement of the toy vehicle; said connecting means including clutch means for connecting said battery case and said support for the front wheel, and means for disabling said clutch means in response to an excess load acting thereon.

2. A radio-controlled two-wheeled toy vehicle comprising a body; front and rear wheels; a drive mechanism for the rear wheel; a support for the front wheel; a battery case arranged in a lower part of the toy vehicle body; means for pivoting said battery case for right and left with respect to a direction of movement of the vehicle in response to a signal from radio control means to provide for the toy vehicle steering to the right and left, respectively; means for connecting said battery case to said support for the front wheel for enabling inclination of said support for the front wheel and said front wheel to the right and left in accordance with swinging of said battery case to the right and left, respectively; and a driver element mounted on a seat of the toy vehicle and having balance weights arranged within said driver element swingable right and left with respect to the direction of movement of the toy vehicle to accelerate inclination of the toy vehicle body in a respective direction to thereby enable a rapid change of the direction of movement of the toy vehicle; said toy vehicle having a longitudinal extent having a middle point, said driver element having an upper portion, said balance weights being arranged in said upper portion in a location lying in the middle point of the longitudinal extent of the toy vehicle.

3. A radio-controlled two-wheeled toy vehicle comprising a body; front and rear wheels; a drive mechanism for the rear wheel; a support for the front wheel; a battery case arranged in a lower part of the toy vehicle body; means for pivoting said battery case right and left with respect to a direction of movement of the vehicle in response to a signal from radio control means to provide for the toy vehicle steering to the right and left, respectively; and means for connecting said battery case to said support for the front wheel, said connecting means comprising a crank arm attached to said battery case for joint pivotal movement therewith, a header connected to said support for the front wheel for joint inclination movement therewith right and left with respect to a movement direction of the toy vehicle, a crank connected with said crank arm and said header for transforming a pivotal movement of said battery case into an inclination movement of said header, and communication means for connecting said crank and said header and limiting the inclination movement of said header, said crank having a first shaft, said header having a second shaft, and said communication means comprising a tubular portion for connecting said first and second shaft and stop means for limiting the inclination movement of said header.

4. A radio controlled two-wheeled toy vehicle according to claim 3, further comprising means for disconnecting said first and second shaft in response in load acting on said connecting means exceeding a predetermined value.

* * * * *